US009693921B2

(12) United States Patent
Koger et al.

(10) Patent No.: US 9,693,921 B2
(45) Date of Patent: Jul. 4, 2017

(54) SYSTEMS FOR PATIENT TRANSFER, DEVICES FOR MOVEMENT OF A PATIENT, AND METHODS FOR TRANSFERRING A PATIENT

(71) Applicant: DIACOR, Inc., West Valley City, UT (US)

(72) Inventors: Michael R. Koger, Commerce City, CO (US); Kevin R. Anderson, Salt Lake City, UT (US); Frederic A. Gibbs, Jr., Ashland, OR (US); Christopher F. Johnson, Bountiful, UT (US)

(73) Assignee: DIACOR, Inc., West Valley City, UT (US)

( * ) Notice: Subject to any disclaimer, the term of this patent is extended or adjusted under 35 U.S.C. 154(b) by 506 days.

(21) Appl. No.: 14/167,747

(22) Filed: Jan. 29, 2014

(65) Prior Publication Data

US 2014/0143950 A1 May 29, 2014

Related U.S. Application Data

(60) Continuation of application No. 13/927,646, filed on Jun. 26, 2013, now Pat. No. 8,640,279, which is a (Continued)

(51) Int. Cl.
*A47C 21/06* (2006.01)
*A61G 1/003* (2006.01)
(Continued)

(52) U.S. Cl.
CPC ..... *A61G 7/1028* (2013.01); *A61G 7/103* (2013.01); *A61G 7/1034* (2013.01); (Continued)

(58) Field of Classification Search
CPC .... A61G 7/1028; A61G 7/103; A61G 7/1034; A61G 7/1098; A61G 13/10; A61G 13/12; (Continued)

(56) References Cited

U.S. PATENT DOCUMENTS 3,644,950 A 2/1972 Lindsay, Jr.
3,667,073 A 6/1972 Renfroe
(Continued)

*Primary Examiner* — David E Sosnowski
(74) *Attorney, Agent, or Firm* — TraskBritt

(57) ABSTRACT

A patient transfer sled has a support structure including at least one air cushion adjacent a major surface thereof. The air cushion includes a flexible material at least partially surrounding a rigid material, and a portion of the flexible material has a plurality of holes extending therethrough. Systems for patient transfer may include a support surface, such as a table, a patient transfer sled having at least one air cushion, and a source of pressurized air. Methods for moving a patient relative to a support surface include positioning a patient on a patient transfer sled having at least one air cushion, and inflating the air cushion with air to form a sheet of flowing air between the patient transfer sled and the support surface. The methods may be used, for example, to move a patient on an air film over a surface within a system.

20 Claims, 8 Drawing Sheets

Related U.S. Application Data division of application No. 12/563,015, filed on Sep. 18, 2009, now Pat. No. 8,490,226.

(60) Provisional application No. 61/098,663, filed on Sep. 19, 2008.

(51) Int. Cl.
*A61G 7/10* (2006.01)
*A61G 13/10* (2006.01)
*A61G 13/12* (2006.01)

(52) U.S. Cl.
CPC ..... *A61G 7/1098* (2013.01); *A61G 13/10* (2013.01); *A61G 13/12* (2013.01); *A61G 13/1245* (2013.01); *A61G 13/1265* (2013.01); *A61G 2210/50* (2013.01)

(58) Field of Classification Search
CPC ..... A61G 13/1245; A61G 13/1265; A61G 2210/50
See application file for complete search history.

(56) References Cited

U.S. PATENT DOCUMENTS 3,669,031 A 6/1972 Cole
3,739,407 A 6/1973 Stiller
3,760,899 A 9/1973 Crossman et al.
3,778,851 A 12/1973 Howorth
3,822,425 A 7/1974 Scales
3,948,344 A 4/1976 Johnson et al.
4,155,421 A 5/1979 Johnson et al.
4,272,856 A 6/1981 Wegener et al.
4,275,896 A 6/1981 Eicher
4,279,044 A 7/1981 Douglas
4,298,083 A 11/1981 Johnson et al.
4,347,633 A 9/1982 Gammons et al.
4,391,009 A 7/1983 Schild et al.
4,399,885 A 8/1983 Johnson et al.
4,417,639 A 11/1983 Wegener
4,528,704 A 7/1985 Wegener et al.
4,631,767 A 12/1986 Carr et al.
4,686,719 A 8/1987 Johnson et al.
4,805,626 A 2/1989 DiMassimo et al.
4,896,389 A 1/1990 Chamberland
5,035,016 A 7/1991 Mori et al.
5,065,464 A 11/1991 Blanchard et al.
5,129,765 A 7/1992 Smith
5,251,347 A 10/1993 Hopper et al.
5,483,709 A 1/1996 Foster et al.
RE35,299 E 7/1996 Weedling et al.
5,561,873 A 10/1996 Weedling
5,647,079 A 7/1997 Hakamiun et al.
5,699,570 A 12/1997 Wilkinson et al.
5,774,916 A 7/1998 Kurhi
5,794,289 A 8/1998 Wortman et al.
6,016,582 A 1/2000 Larson
6,098,221 A 8/2000 Kloppenborg
6,199,508 B1 3/2001 Miale et al.
6,240,584 B1 6/2001 Perez et al.
6,467,106 B1 10/2002 Heimbrock
6,596,018 B2 7/2003 Endo et al.
6,687,937 B2 2/2004 Harker
6,701,544 B2 3/2004 Heimbrock
6,775,868 B1 8/2004 Mileti et al.
6,813,790 B2 11/2004 Flick et al.
6,820,292 B2 11/2004 Heimbrock
6,904,629 B2 6/2005 Wu
7,032,261 B2 4/2006 Heimbrock
7,065,815 B2 6/2006 Buchanan
7,107,641 B2 9/2006 Davis
7,114,204 B2 10/2006 Patrick
7,146,660 B2 12/2006 Heimbrock
7,228,579 B2 6/2007 Tidwell
7,469,432 B2 12/2008 Chambers
7,565,709 B2 7/2009 Davis
7,627,910 B2 12/2009 Davis
7,712,164 B2 5/2010 Chambers
7,712,170 B2 5/2010 Davis
7,725,963 B2 6/2010 Johnson
7,735,164 B1 6/2010 Patrick
7,861,335 B2 1/2011 DeLuca et al.
7,914,611 B2 3/2011 Vrzalik et al.
8,006,333 B2 8/2011 Genaro et al.
8,118,920 B2 2/2012 Vrzalik et al.
8,191,187 B2 6/2012 Brykalski et al.
8,220,090 B2 7/2012 Gowda
8,276,222 B1 10/2012 Patrick
8,302,222 B2 11/2012 Jasani
8,656,528 B2 * 2/2014 Perelman ..... A61G 7/1028 5/601
9,381,127 B2 * 7/2016 Scholz ..... A61G 7/1025
2002/0124319 A1 9/2002 Giori et al.
2002/0162172 A1 11/2002 Federowicz
2003/0150060 A1 8/2003 Huang
2003/0159212 A1 8/2003 Patrick et al.
2005/0081300 A1 4/2005 O'Reagan et al.
2005/0166325 A1 8/2005 Tidwell
2005/0262638 A1 12/2005 Libunao
2005/0278863 A1 12/2005 Bahash
2006/0000016 A1 1/2006 Weedling
2006/0021133 A1 2/2006 Davis
2006/0253976 A1 11/2006 Weedling et al.
2007/0079439 A1 4/2007 Patterson et al.
2007/0136952 A1 6/2007 Sargent
2007/0234481 A1 10/2007 Totton et al.
2008/0098532 A1 5/2008 Gowda
2009/0106907 A1 4/2009 Chambers
2009/0217460 A1 9/2009 Bobey et al.
2009/0271923 A1 11/2009 Lewis
2010/0024123 A1 2/2010 Davis
2010/0071127 A1 3/2010 Koger et al.
2012/0304384 A1 12/2012 Scholz et al.
2013/0212806 A1 8/2013 Coppens et al.
2013/0283525 A1 10/2013 Koger et al.
2013/0318707 A1 * 12/2013 Perelman ..... A61G 7/1028 5/81.1 HS
2015/0143628 A1 5/2015 Fowler et al.

* cited by examiner

SYSTEMS FOR PATIENT TRANSFER, DEVICES FOR MOVEMENT OF A PATIENT, AND METHODS FOR TRANSFERRING A PATIENT

CROSS-REFERENCE TO RELATED APPLICATIONS

This application is a continuation of U.S. patent application Ser. No. 13/927,646, filed Jun. 26, 2013, now U.S. Pat. No. 8,640,279, issued Feb. 4, 2014, which is a divisional of U.S. patent application Ser. No. 12/563,015, filed Sep. 18, 2009, now U.S. Pat. No. 8,490,226, issued Jul. 23, 2013, which claims the benefit under 35 U.S.C. §119(e) of U.S. Provisional Patent Application No. 61/098,663, filed on Sep. 19, 2008. The entire disclosures of each of these applications are incorporated herein by this reference.

FIELD

The present invention relates generally to systems, apparatuses, and methods for transferring patients from one location to another.

BACKGROUND

Apparatuses for positioning patients in a precise and immobilized manner are often used in treating patients using radiation application therapies, such as, for example, brachytherapy. In order to control the concentration of energy to specific localized areas of a patient; it is necessary to precisely position treatment applicators and ensure that patient movement does not occur during the application of the therapy. To facilitate application of energy to specific localized areas, the placement of treatment applicators may be verified prior to treatment. This verification may require movement of the patient between a hospital bed, gurney, and/or an imaging platform such as those used when operating a computed tomography (CT) scanning system or a magnetic resonance imaging (MRI) system. However, movement of the patient may undesirably alter the position of the treatment applicators.

It has been proposed to utilize air bearings in the transport of patients. Typical devices of this type employ a flexible perforated bottom sheet for defining a plenum chamber. When the chamber is filled with air, it initially lifts the load upwardly, then as air escapes through the perforations it creates an air bearing between the underlying support surface and the bottom of the perforated flexible sheet. A load may thus be supported by the thin film of pressurized air. An air bearing operates with essentially zero static and running friction which allows for the effortless, smooth movement of a load over a surface. Some devices for patient transfer employing an air bearing are currently known. Generally, these devices create the air bearing using an inflatable bladder. The bladder acts as a mattress upon which a patient lies. Pressurized air passes into and through the bladder creating an air film in the gap between the mattress and the surface underlying it.

In certain instances, the air bearing device may additionally have a semi-rigid backing member, for instance of cardboard. The semi-rigid backing member may be inserted into the plenum chamber to act as an air dispersion means. In another device, the air-chamber is formed of multiple sheets, both flexible and semi-rigid, which are bonded together.

Accordingly, there is a need in the art for improved systems, apparatuses, and methods for moving patients while at least substantially maintaining the positions and orientations of the patients.

BRIEF SUMMARY

In some embodiments, the present invention includes methods for moving a patient relative to a surface using a patient transfer sled having at least one air cushion. Air may be flowed into and through the air cushion causing it to inflate and form an air film between the patient transfer sled and the support surface. The patient transfer sled may be supported on the air film while being moved over the surface.

In additional embodiments, the present invention includes a patient transfer sled having a support structure with at least one pocket or recess formed therein. The patient transfer sled includes at least one air cushion partially disposed within the at least one pocket, and an air passageway extending through the support structure into the air cushion. The patient transfer sled may also have at least one leg support affixed to a base end of the support structure.

In further embodiments, the present invention includes systems for patient transfer that may include a support surface, such as a table, a patient transfer sled having at least one air cushion, and a source of pressurized air. The system may also have a bridge, comprising a substantially planar surface, which may close any surface gaps between adjacent support structures.

DETAILED DESCRIPTION

The present invention provides a method of patient transfer, components for use in a patient transfer system, as well as patient transfer systems that have advantages over currently known systems. It will be appreciated by those skilled in the art that the embodiments herein described, while illustrating certain specific and exemplary embodiments, are not intended to limit the invention or the scope of the appended claims. Those of ordinary skill in the art will also understand that various combinations or modifications of the disclosed embodiments may be made without departing from the scope of the invention.

As used herein, the term "upper end" means and includes the longitudinal end portion of a patient transfer sled that is proximal to the head of a patient when the patient is supported on the sled. As used herein, the term "base end" means and includes the longitudinal end portion of a patient transfer sled that is proximal to the feet of a patient when the patient is supported on the sled.

As used herein, the terms "top side" and "top surface" mean and include the side and surface, respectively, of a patient transfer sled adjacent the body of a patient when the patient is supported on the sled. As used herein, the terms "bottom side" and "bottom surface" mean and include the side and surface, respectively, of a patient transfer sled that are opposite the body of a patient when the patient is supported on the sled.

Figure 1:
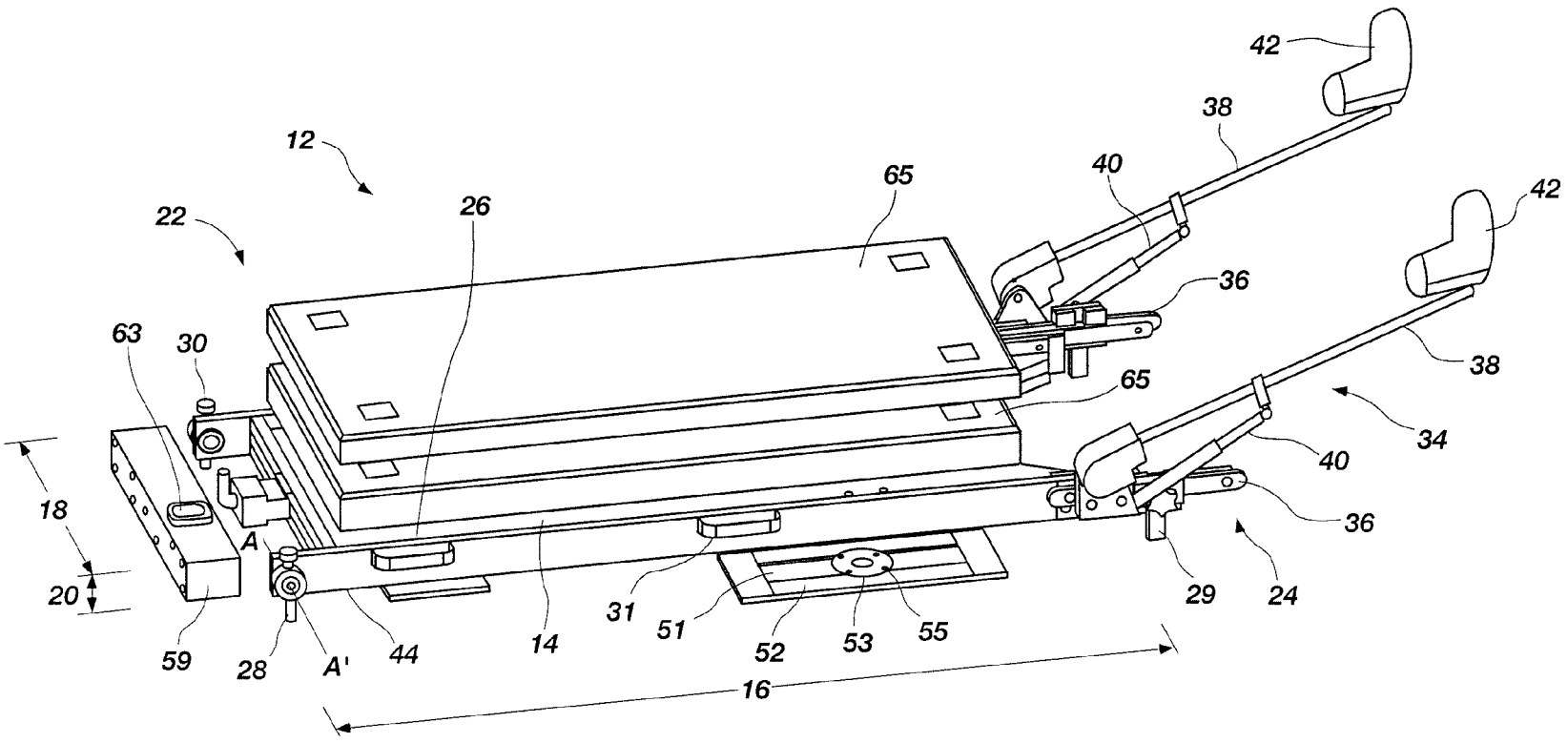
FIG. 1 is an exploded view of partially assembled components of an embodiment of a patient transfer sled for use in a patient transfer system in accordance with the present invention.

FIG. 1 is a partially exploded view of an embodiment of a patient transfer sled 12 in accordance with the present invention, which may be used in conjunction with a patient transfer system as described in further detail hereinbelow. As shown in FIG. 1, the patient transfer sled 12 comprises a generally planar support structure 14, upon which at least a portion of the body of a patient may be supported. The support structure 14 has an upper end 22 and a base end 24. When a patient is positioned upon the patient transfer sled 12, the head of the patient may rest upon a top surface 26, near the upper end 22. In some embodiments, the head of the patient may rest upon a cushion 65 (described further below) overlying the support structure 14.

The support structure 14 may include a number of components, as described in further detail below, which may be comprised of a generally rigid material. By way of non-limiting example, the components of the support structure 14 may be formed from and comprise a metal material (e.g., a commercially pure metal or a metal alloy), a plastic material, or a composite material. For example, components of the support structure 14 may comprise a composite material having carbon fibers embedded within a matrix material, such as epoxy. In such embodiments, the components of the support may include a foam material surrounded by, or sandwiched between, relatively thin layers or "skins" of carbon fiber material. It is noted that carbon fiber materials may be nearly transparent to x-rays, and may minimize x-ray image artifacts when using the patient transfer sled 12 in accordance with embodiments of methods of the present invention, as described hereinbelow. In other embodiments, the components of the support structure 14 may comprise polyvinyl chloride (PVC), polycarbonate, an aromatic polyamide (e.g., KEVLAR®), polyethylene, or polytetrafluoroethylene (PTFE). It may be desirable to form the support structure 14 from a relatively light material to increase a load bearing capacity of the support structure 14, as will be apparent from the description below.

The support structure 14 may have any suitable shape or geometry, such as, for example, a rectangular shape or an elliptical shape. The support structure 14 may comprise a substantially rectangular three-dimensional structure having a length 16, a width 18, and a height 20. The length 16 may be substantially greater than the width 18, and both the length 16 and width 18 may be greater than the height 20. The length 16 of the support structure 14 may be, for example, from about one-hundred and twenty-five (125) centimeters to about two-hundred (200) centimeters, the width 18 of the planar support structure 14 may be, for example, from about sixty-one (61) centimeters to about ninety-one (91) centimeters, and the height 20 of the planar support structure 14 may be, for example, from about ten (10) centimeters to about fifty (50) centimeters. The overall height of the patient transfer sled 12 may, optionally, be increased by increasing the number of cushions 65 overlying the planar support structure 14.

With continued reference to FIG. 1, the patient transfer sled 12 may include a plurality of guides 28, 29, which may be disposed longitudinally along opposing lateral sides of the support structure 14, and may be used to guide movement of the patient transfer sled 12 and/or to secure the patient transfer sled 12 in place on an underlying surface or structure. The guides 28, 29 may be formed of and comprise a metal or metal alloy, such as, for example, aluminum or stainless steel. The plurality of guides 28, 29 may comprise guides 28 proximal the upper end 22 of the patient transfer sled 12 and guides 29 proximal the base end 24 of the patient transfer sled 12. The guides 28, 29 may be substantially the same or, alternatively, may be substantially different.

In an embodiment illustrated in FIG. 1, the guides 28 may be pivotally attached to the opposing lateral sides of the support structure 14. The guides 28 may include a handle 30 that may be used to rotate the guides 28 relative to the support structure 14. If such a configuration is employed, when the handle 30 is rotated approximately 90° relative to the plane of the support structure 14, the corresponding guide 28 may be caused to pivot between a horizontal orientation and a vertical orientation. Each handle 30 and guide 28 may be rotated around a horizontal rotational axis, as shown in FIG. 1 by the line A-A'. For example, the guides 28 may be rotatable between a first position, in which each guide 28 extends downward beyond a bottom surface 44 of the support structure 14 and beside a lateral side of an underlying table (not shown in FIG. 1), and a second position, in which each guide 28 is disposed laterally adjacent the support structure 14 above the bottom surface 44 thereof, such that the guides 28 do not interfere with any table or surface on which the support structure 14 may be resting. With the guides 28 in a first, vertical position, the sled 12 may be constrained to longitudinal movement along an underlying table disposed between the guides 28, and the guides 28 may prevent the sled 12 from moving in a lateral or sideways direction relative to the underlying table.

Figure 2B:
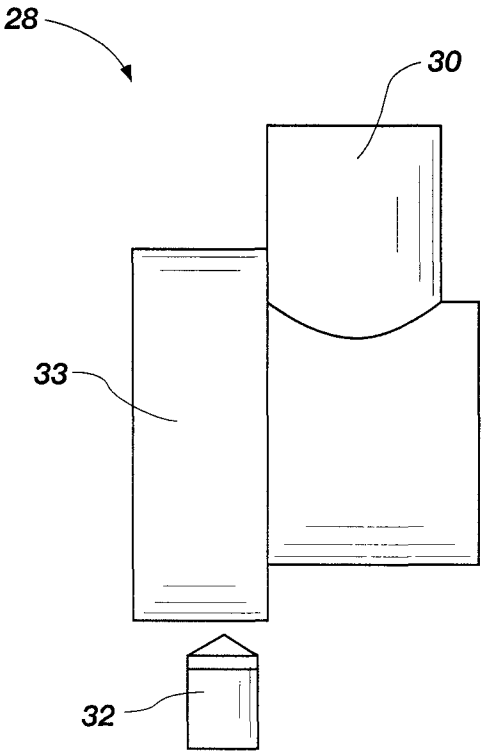
FIG. 2B is a side view of a guide member of the patient transfer sled shown in FIG. 1.
Figure 2A:
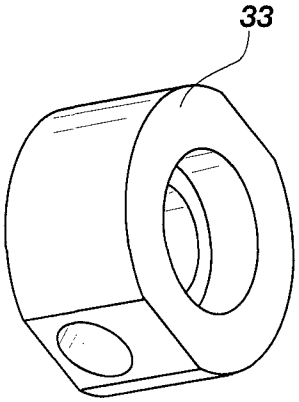
FIG. 2A is a perspective view of a component of a locking device of the patient transfer sled shown in FIG. 1.

As shown in FIGS. 2A and 2B, the guides 28 may include a wheel or collar 33 that rotates about the rotational axis that extends along line A-A' in FIG. 1. The guides 28 may include a locking means for holding the guides 28 in one or both of the horizontal position and the vertical position and preventing undesirable rotation of the guides 28. For example, each guide 28 may include a spring-loaded detent, such as a spring-loaded pin 32, that is configured to be received in one or more openings or recesses in the collar 33 attached to each respective guide 28. When the spring-loaded pin 32 is disposed within such an opening or recess in the collar 33, the spring-loaded pin 32 may hold each guide 28 in a fixed rotational position. FIGS. 2A and 2B illustrate one example embodiment of a guide 28 that includes a handle 30 and a locking means for holding the guide 28 in a fixed position, but other configurations of guides may be used in embodiments of the present invention.

For example, another embodiment of the plurality of guides 28, 29 is also depicted in FIG. 1. The guides 29 may be adjustably mounted to the opposing lateral sides of the support structure 14. Each guide 29 may comprise a flat blade portion and a portion that projects from the flat blade. The lateral sides of the support structure 14 may include an opening or slot (not shown) for receiving the projecting portion of the guides 29. In other embodiments, the opening or slot for receiving the projecting portion of the guides 29 may be provided in brackets 36 (described further below). The projecting portion of the guides 29 may be configured to slide within the slot in a vertical direction relative to the plane of the support structure 14. If such a configuration is employed, the projecting portion of each guide 29 may be movable from a first position, proximal a second major surface (e.g., the bottom surface 44), to a second position proximal a first major surface (e.g., the top surface 26) of the support structure 14.

The guides 29 may include a locking means for holding the guide 29 in any vertical position within the slot. For example, the guides 29 may include a clamp to hold each guide 29 in a fixed vertical position. With the guides 29 secured in the first position the flat blade portion of each guide 29 extends downward beyond the bottom surface 44 of the support structure 14 and beside a lateral side of an underlying table (not shown in FIG. 1). With the guides 29 secured in the second position the flat blade portion of each guide 29 is disposed adjacent the support structure 14 above the bottom surface 44 thereof, such that the guides 29 do not interfere with any table or surface on which the support structure 14 may be resting. With the guides 29 in the first vertical position, the sled 12 may be constrained to longitudinal movement along an underlying table disposed between the guides 29, and the guides 29 may prevent the sled 12 from moving in a lateral or sideways direction relative to the underlying table. Other configurations of guides may also be used in embodiments of the present invention.

With continued reference to FIG. 1, additional handles 31 may be provided on one or more lateral sides of the support structure 14. Such additional handles 31 may be used to move the sled 12 during patient transfer.

As shown in an embodiment in FIG. 1, the patient transfer sled 12, optionally, may include one or two leg supports 34. The leg supports 34 may extend from the support structure 14. The support structure 14 may have one or more brackets 36 configured to connect the leg supports 34 to the support structure 14. The brackets 36 may be attached to the base end 24 of the patient transfer sled 12. The leg supports 34 may comprise a pair of similar, separate, supports 34 attached to brackets 36 on opposing lateral sides of the base end 24 of the support structure 14.

Figure 9:
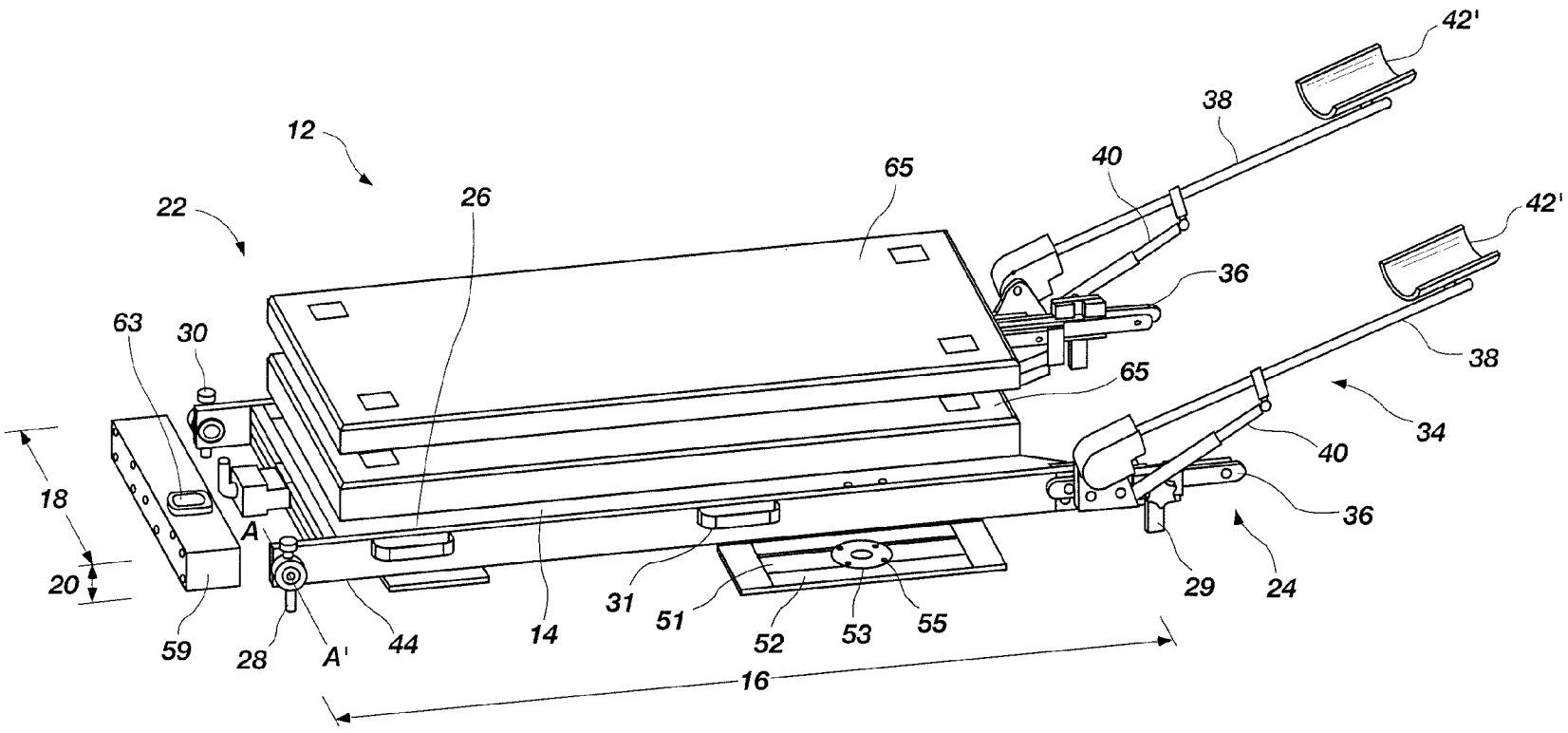
FIG. 9 is an exploded view of partially assembled components of an embodiment of another patient transfer sled for use in a patient transfer system in accordance with the present invention.

The leg supports 34 may include a weight bearing rod 38 and a separate damper 40 that is connected to the weight bearing rod 38 such that the damper 40 may slide relative to the rod 38 to accommodate the varying leg lengths of patients to be supported by the sled 12. A foot rest 42 or other body support structure may be connected to each of the weight bearing rods 38. The foot rests 42 may be boots for receiving the feet of a patient therein while the patient is resting in a supine position on the sled 12. Alternatively, the foot rests 42 may be stirrups 42', shown in FIG. 9, or any other device suitable for supporting the feet or legs of a patient. One embodiment of the leg support 34, weight bearing rod 38, and damper 40 for fastening to bracket 36 mounted on the support structure 14 is shown in detail in FIG. 1, although other structures and configurations also may be employed in embodiments of patient transfer sleds of the present invention.

In additional embodiments, a single support structure (not shown) may be used to support both legs of a patient in an elevated position as the patient is resting on the patient transfer sled 12. The single support may have a flat surface upon which a patient's feet or legs may be supported. In still other embodiments, the legs of a patient may be entirely supported by the patient transfer sled 12 (i.e., without the use of optional leg supports 34). The patient transfer sled 12 may be longer in such embodiments, so as to support the entire length of the body of a patient.

Figure 7:
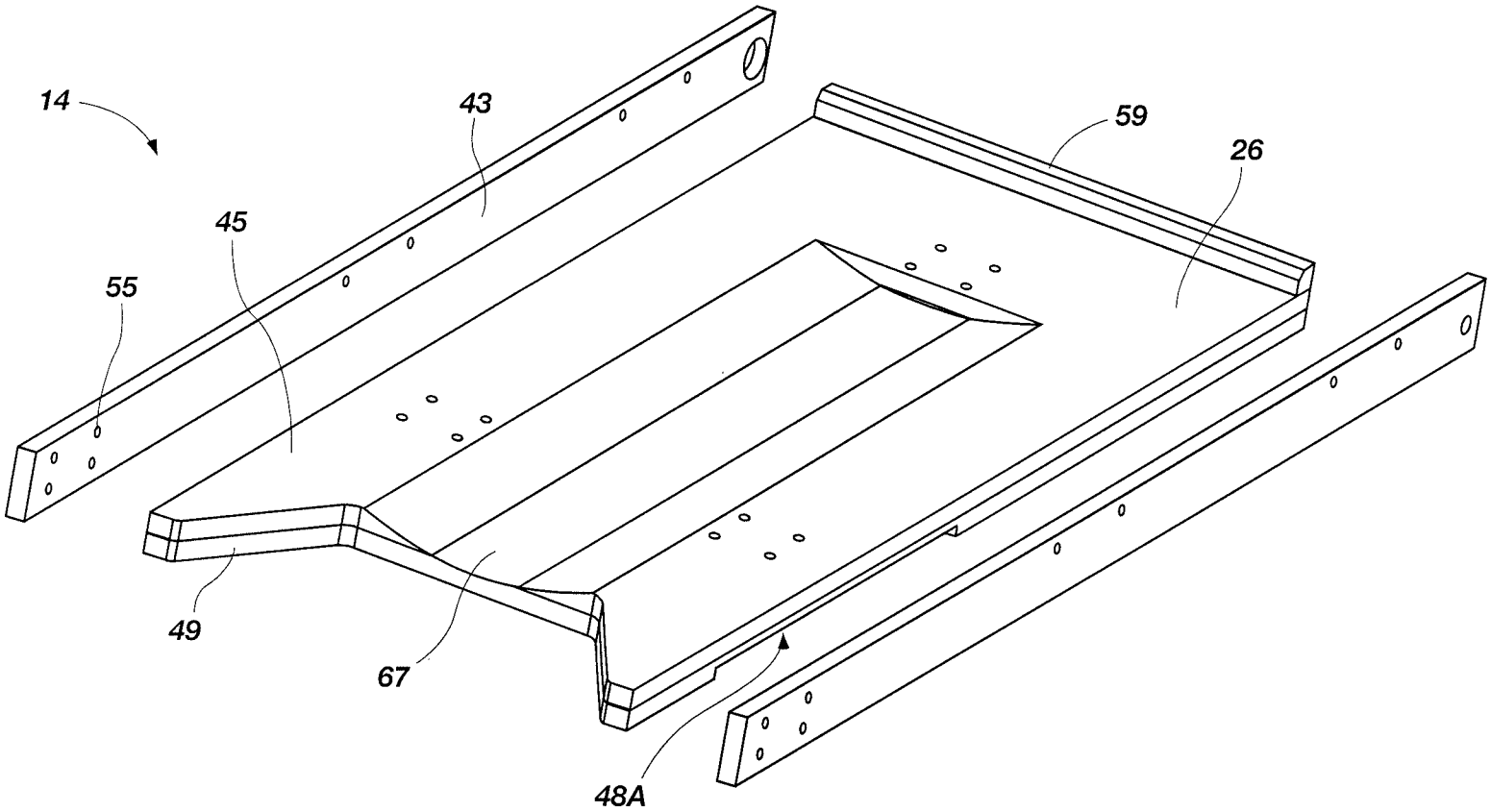
FIG. 7 is an exploded view of partially assembled components of an embodiment of a support structure of the patient transfer sled shown in FIG. 1.

FIG. 1 depicts a top perspective view of the support structure 14 of the patient transfer sled 12. As shown in FIG. 1, the support structure 14 has a major top surface 26 and a second, opposed, generally parallel and planar major bottom surface 44 that is opposite the top surface 26. The top surface 26 may be at least substantially planar. In other embodiments, the top surface 26 may conform to a patient's body. In still further embodiments, as described in further detail below, the top surface 26 of the support structure 14 may have a recess or depression 67 (FIG. 7). Optionally, one or more cushions 65 may be provided over the top surface 26 of the support structure 14 to provide patient comfort. The one or more cushions 65 may deform when the body of a patient is supported thereon, such that the one or more cushions 65 conform to the recess 67 in the support structure 14. The top surface 26 and the one or more cushions 65 may optionally be configured to have rounded corners and edges for patient comfort. The top surface 26 and the one or more cushions 65 also may be covered or printed with a distinguishing pattern.

The guides 28, 29 as shown in FIG. 1, are in a locked, vertical position (the first position described hereinabove), which may prevent the patient transfer sled 12 from moving in a lateral direction. The top surface 26 may also have straps or restraints (not shown) for holding a patient in a desired location over the top surface 26.

Figure 3:
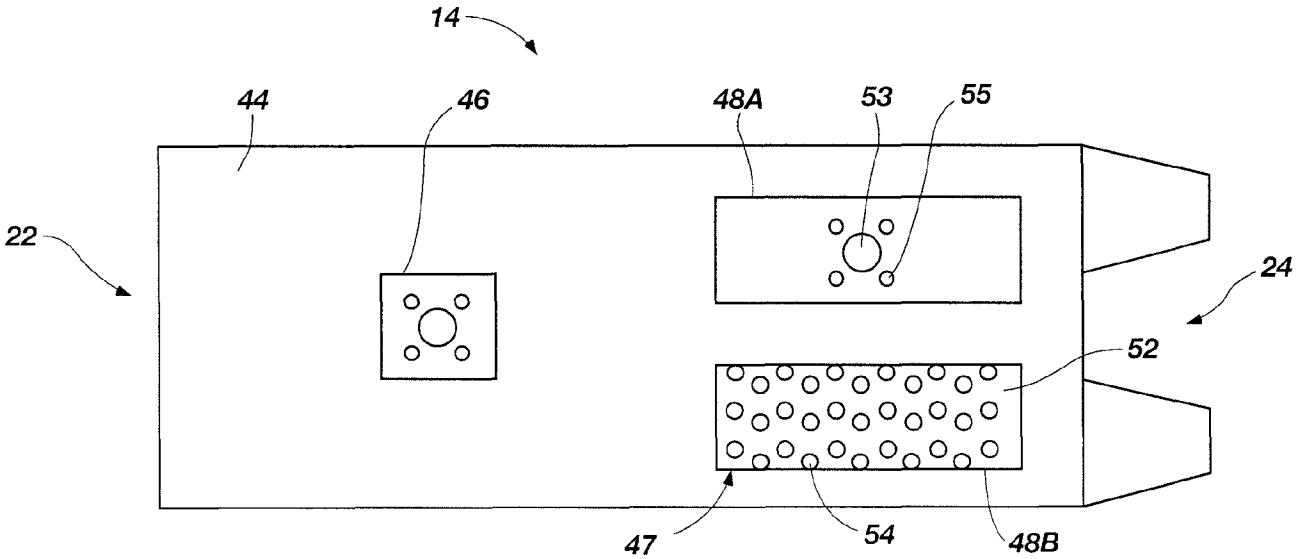
FIG. 3 is a bottom view of an air cushion support structure of the patient transfer sled shown in FIG. 1.

FIG. 3 is a bottom plan view of the support structure 14 of the patient transfer sled 12. As shown in FIG. 3, the bottom surface 44 thereof may have at least one pocket or recess 46 formed or otherwise provided therein. In some embodiments, the support structure 14 may include a plurality of pockets formed or otherwise defined therein. As an example, the support structure 14 may have a first pocket 46, a second pocket 48A, and a third pocket 48B, as shown in FIG. 3. Further, the first pocket 46 may be located near the upper end 22 of the support structure 14, and each of the second pocket 48A and the third pocket 48B may be located near the base end 24. As shown in FIG. 3, in some embodiments, one pocket (e.g., the first pocket 46) may have a smaller area than another pocket (e.g., the second pocket 48A and the third pocket 48B). The pockets 46, 48A, 48B may have any geometry such as, for example, a rectangular shape, a circular shape, or a diamond shape. In addition, the pockets 46, 48A, 48B may have the same geometry, or they may have different geometries. As shown in FIG. 3, an air cushion 47 may be disposed within each of the pockets 46, 48A, 48B, although only one air cushion 47 is shown in FIG. 3 and is disposed in the third pocket 48B.

Figure 4B:
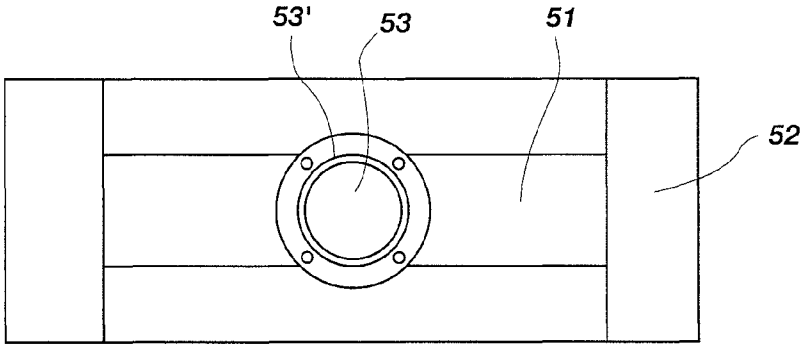
FIG. 4B is a top view of the air cushion shown in FIG. 4A.
Figure 4A:
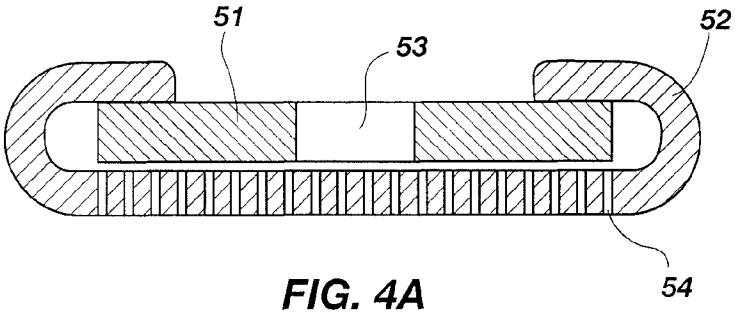
FIG. 4A is a cross-sectional view of an air cushion of the patient transfer sled of FIG. 1.

The cushions 47 may be used to form one or more air bearings under the sled 12, as discussed in further detail below. A simplified schematic illustration of an example embodiment of a cushion 47 is shown in FIGS. 4A and 4B. As shown therein, a flexible material 52 may be affixed to a generally thin, rigid sheet 51. The flexible material 52 may be a vinyl fabric material. In other embodiments, the flexible material 52 may be a rubberized fabric material. Further, the flexible material 52 may have a plurality of holes 54 extending therethrough to allow pressurized air within the air cushion 47 (in an interior space defined between the flexible material 52 and the sheet 51) to flow out from the cushion 47 through the holes, thereby forming a sheet or film of flowing air between the flexible material 52 and an underlying surface.

The thin rigid sheet 51 may be placed onto a portion of the flexible layer 52, and the flexible layer may be partially folded over the edges of the rigid sheet 51 and adhered to a back side of the rigid sheet 51, as shown in FIGS. 4A and 4B. Furthermore, the rigid sheet 51 may comprise an air inlet 53 which allows air to flow from a fluid or air passageway 50 (FIG. 5B) within the support structure 14 into the air cushion 47. In some embodiments, the air inlet 53 may include a one-way valve 53' (FIG. 4B) that allows air to enter the air cushions 47, but does not allow air to escape back into the air passageway 50. The one-way valve 53' facilitates gradual, rather than sudden, deflation upon loss of air flow into the air cushion 47. The flexible material 52 may be attached to the rigid sheet 51 such that an interior space is provided between the rigid sheet 51 and the flexible material 52 when filled with air. In other words, the flexible material 52 may not conform tightly to the lateral side and/or bottom surfaces of the rigid sheet 51.

Referring again to FIG. 3, the air cushions 47 provide a plurality of air bearings under the patient transfer sled 12. The number of air bearings formed is equal to the number of air cushions 47 included in the sled 12. Two air bearings may be formed in which one is designed to hold a larger volume of air than the other. Alternatively, a plurality of air bearings may be designed to hold the same or varying volumes of air. As an example, the first pocket 46 may have the dimensions of 15.5 inches by 15.5 inches, and each of the second pocket 48A and the third pocket 48B may have dimensions of 15.5 inches by 9.5 inches. As another example, the first pocket 46 may have the dimensions of 6 inches by 8 inches, and each of the second pocket 48A and the third pocket 48B may have dimensions of 16 inches by 6 inches. The dimensions of the air cushions 47 will at least partially determine the amount of weight that may be supported by the patient transfer sled 12. Each of the air cushions 47 may be configured to have the same lift value or capacity. In additional embodiments, one or more of the air cushions 47 may be configured to have a different lift value or capacity relative to one or more of the other air cushions 47.

It is understood that the air cushions 47 may be formed in a variety of configurations to satisfy particular applications. By way of example and not limitation, a single cushion 46 may be provided near the upper end 22 of the planar support structure 14 (i.e., adjacent the neck/head region of a patient lying thereon), and at least two cushions 48A, 48B may be positioned longitudinally near the base end 24 of the support structure 14 (i.e., adjacent the lower back region of a patient lying thereon). If the support structure 14 is configured to support the legs of a patient without using the optional leg supports 34, additional air cushions may be provided and configured to lift the region of the support structure 14 supporting the legs of the patient.

The support structure 14 may comprise a plurality of separate layers that may be stacked over one another and secured together to form the support structure 14. Such layers are described in further detail below with reference to FIGS. 5A through 6B.

Figure 5A:
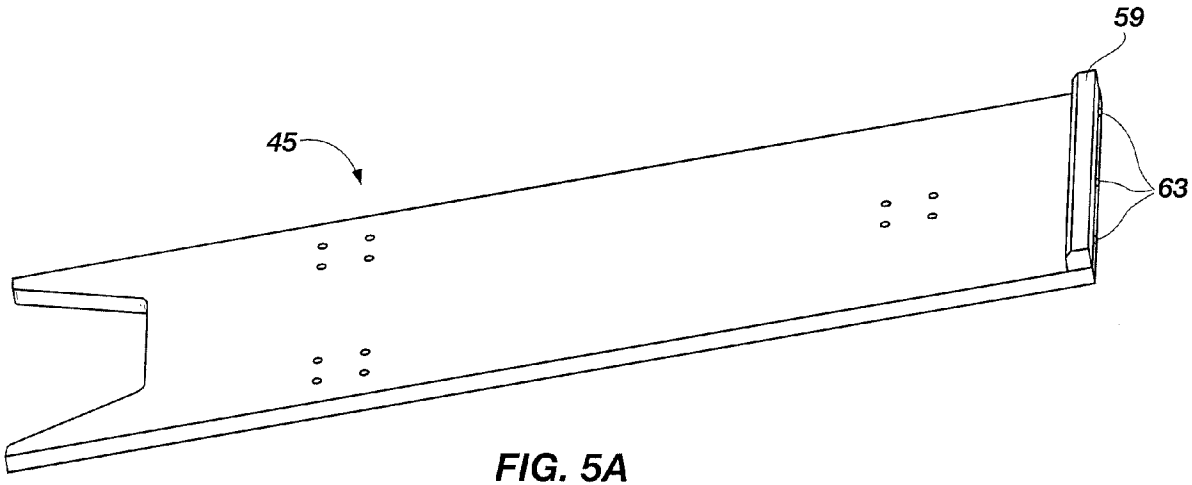
FIG. 5A is a plan view from a top surface of a fluid passageway layer of the patient transfer sled shown in FIG. 1.
Figure 5B:
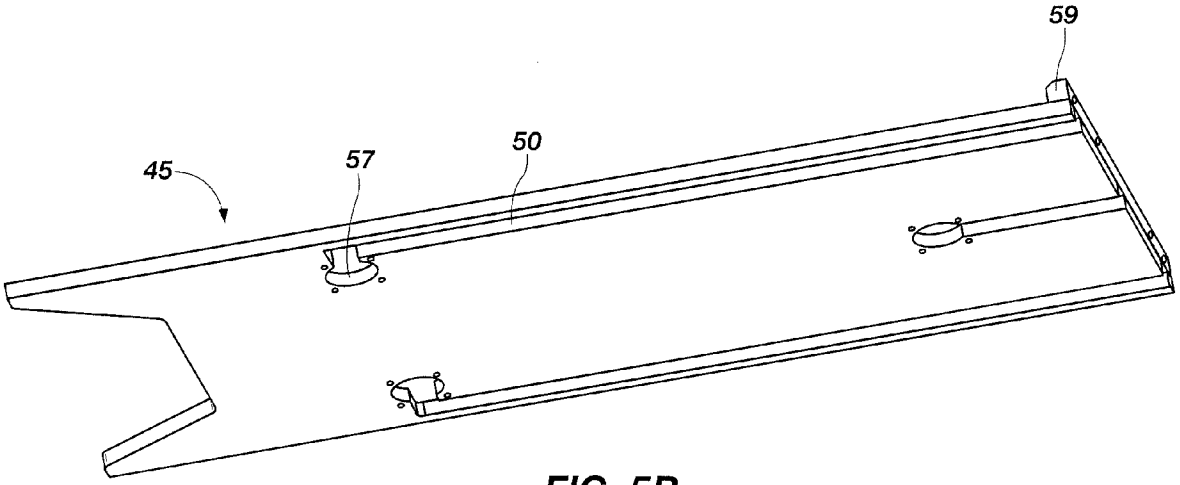
FIG. 5B is a plan view from a bottom surface of a fluid passageway layer of the patient transfer sled shown in FIG. 1.

Referring to FIGS. 5A and 5B, the support structure 14 may comprise at least one fluid passageway layer 45. FIG. 5A is a top view of an embodiment of the at least one fluid passageway layer 45 and FIG. 5B is a bottom view of an embodiment of the at least one fluid passageway layer 45. As shown in an embodiment in FIGS. 5A and 5B, the at least one fluid passageway layer 45 may comprise a layer of material having a plurality of recesses or channels formed therein to define fluid passageways 50 that lead to and converge at regions 57 at which air flowing through the fluid passageways 50 may enter the air cushions 47. A manifold 59 may be provided at one end of the fluid passageway layer 45 (e.g., upper end 22). A plurality of air portals 63 may lead from the exterior of the sled 12 to the manifold 59, and the manifold 59 may provide fluid communication between the air portal 63 and each of the fluid passageways 50. In this configuration, a supply of pressurized gas (e.g., air) may be connected to each air portal 63 such that gas will flow into the air inlet 53, through the manifold 59 to the fluid passageways 50, and to the converging regions 57. The support structure 14 may include multiple fluid passageway layers 45 of varied configurations. The at least one fluid passageway layer 45 may comprise the top surface 26 of the support structure 14.

The manifold 59 may include an adjustable valve or damper (not shown) that allows the amount of air flow being supplied to each of the converging regions 57 to be adjusted. In other words, the manifold 59 may include a valve or damper that may be adjusted to provide more air flow to the first pocket 46 and less air flow to each of the second pocket 48A and the third pocket 48B, or vice versa. The valve or damper may be adjusted to provide the same or varying flows to each of the plurality of air pockets 46, 48A, 48B, regardless of the number or configuration of the air pockets 46, 48A, 48B. Such a valve or damper may be desirable to allow the sled 12 to be properly balanced and supported when a patient is resting thereon.

Figure 6A:
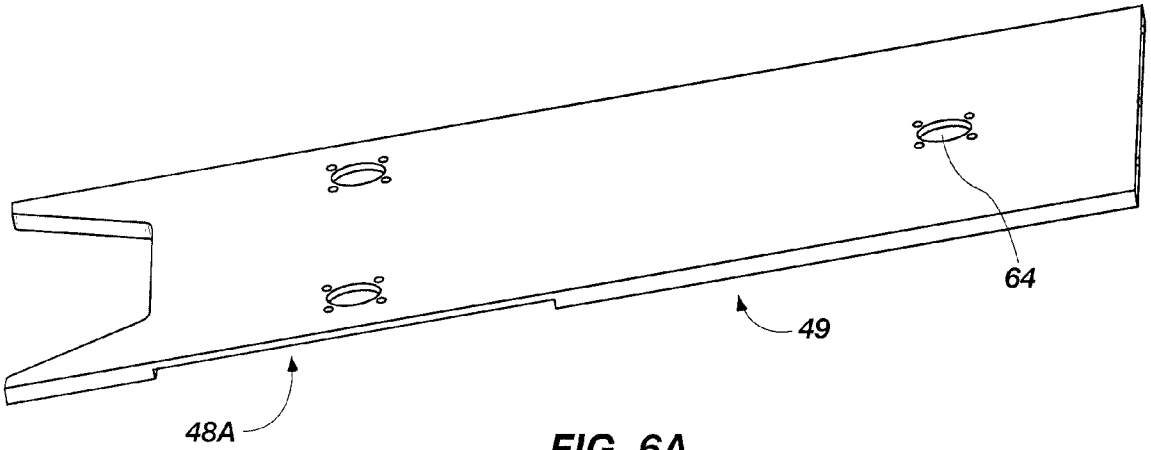
FIG. 6A is a plan view from a top surface of an air bearing frame of the patient transfer sled shown in FIG. 1.
Figure 6B:
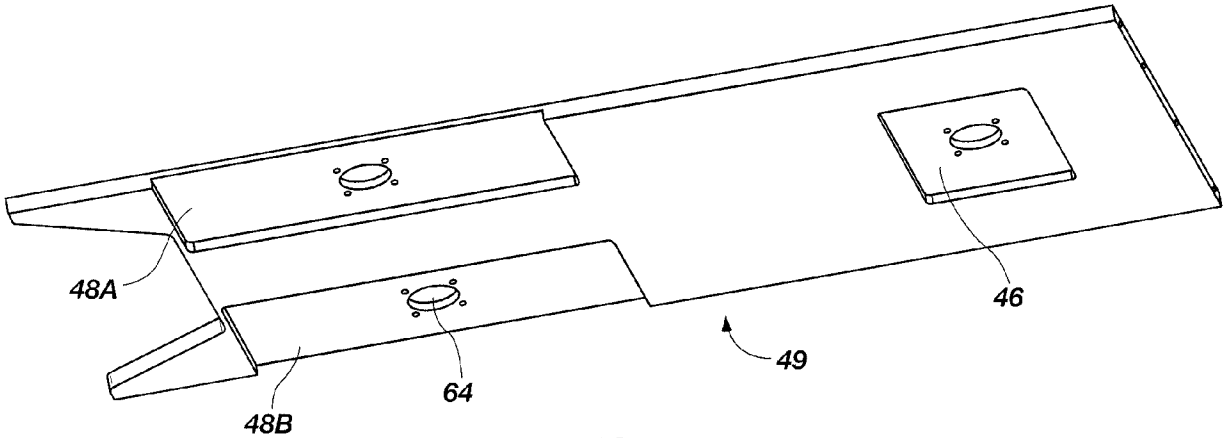
FIG. 6B is a plan view from a bottom surface of an air bearing frame of the patient transfer sled shown in FIG. 1.

Referring to FIGS. 6A and 6B, the support structure 14 also may comprise at least one air bearing frame 49, which may be mounted under and secured to at least one of the fluid passageway layers 45 (FIGS. 5A and 5B). FIG. 6A illustrates a top view of an embodiment of an air bearing frame 49, and FIG. 6B illustrates a bottom view of an embodiment of an air bearing frame 49. The air bearing frame 49 may have one or more openings extending partially therethrough that correspond to and form the pockets 46, 48A, and 48B of the support structure 14. The air bearing frame 49 may comprise the bottom surface 44 of the support structure 14. The air bearing frames 49 define the depths of the pockets 46, 48A, and 48B into which the air cushions 47 are disposed.

The air bearing frame may have at least one aperture 64 extending therethrough positioned adjacent the converging regions 57 of the fluid passageway layers 45 (FIGS. 5A and 5B). When the air bearing frame 49 is secured to the at least one fluid passageway layer 45, the air bearing frame 49 may be used to seal the fluid passageways 50 in the fluid passageway layer 45 such that air flowing through the fluid passageways 50 cannot escape therefrom in any significant volume at any location other than at the converging regions 57 and through apertures 64, into the air cushions 47. The rigid sheets 51 of the air cushions 47 may be attached to the air bearing frame 49 such that the apertures 64 are aligned with the air inlets 53 in the rigid sheets 51, which lead into the interior regions of the air cushions 47.

FIG. 7 depicts an embodiment of the support structure 14 following mounting of the fluid passageway layer 45 to the air bearing frame 49. Optionally, side rails 43 may be mounted or secured to the support structure 14. In some embodiments, the top surface 26 of the support structure 14 may be substantially planar. In other embodiments the top surface 26 of the support structure 14 may be irregular. As shown in an embodiment in FIG. 7, a portion of the fluid passageway layer 45 and a portion of the air bearing frame 49 may be removed to provide an opening or recess 67. In other embodiments, a portion of either the fluid passageway layer 45 or a portion of the air bearing frame 49 may be removed to provide the recess 67. The recess 67 may have any suitable shape or geometry, such as, for example, a rectangular shape or an elliptical shape. The recess 67 may have a curved bottom surface and sidewalls or, alternatively, may have flattened surfaces.

As shown in an embodiment in FIG. 3, the air cushion 47 may be attached within a pocket 48B in the support structure 14. In an embodiment, the air cushion 47 is fastened within the pockets 46, 48A, and 48B around a periphery of the air inlet 53. Fasteners 55 may be any fastener conventional in the art which is capable of holding the air cushion 47 against the support structure 14 when the air cushion 47 is exposed to pressurized air. As air passes through the fluid passageway 50, and out of air inlet 53, the flexible material 52 may inflate with air. As previously mentioned, the air cushions 47 may include a flexible layer 52 having a plurality of holes 54 formed therethrough, which allow air to pass from an interior cavity, encompassed by the flexible layer 52 and the rigid sheet 51, to the exterior of the cushions 47, thereby creating a film or sheet of flowing air underneath the patient transfer sled 12. This film or sheet of flowing air provides an air bearing between the patient transfer sled 12 and any surface upon which it rests, and may provide for at least substantially frictionless movement of the sled 12 across the underlying surface.

A pressurized air source 62, such as a blower (shown in FIG. 8), may be used to supply pressurized air to one or more of the air portals 63 and the fluid passageways 50 of the patient transfer sled 12. The air source 62 may comprise any conventional blower that is capable of supplying pressurized air to the patient transfer sled 12, such as ones manufactured and sold by Nilfisk, Model GM 80, which provides an air flow of approximately 87 cubic feet per minute at 4 psi. An air supply hose may be used to connect the pressurized air source to one or more air portals 63.

In some embodiments, a pressure regulator valve (not shown) may be provided between the pressurized air source 62 and one or more air portals 63 to allow an operator to control the pressure of the air within the air cushions 47 and, hence, the rate at which air flows out from the air cushions 47. As an example, the pressure regulator valve may include a bypass valve that allows an adjustable amount of air to escape out from the bypass valve, instead of flowing into the fluid passageways 50 and the air cushions 47. In other words, as more air is allowed to escape from the bypass valve, less air will flow into the air cushions 47 of the patient transfer sled 12. Such bypass valves are commercially available. Alternatively, the pressure of air within the air cushions 47 may be controlled by other means. For example, the air source 62 may include a variable speed control that allows for adjustment of, for instance, blower speed, air pressure, and lift rate, when inflating and deflating the air cushions 47. The variable speed control may be incorporated into the air source 62 or may comprise a separate device in communication with the air source 62.

Figure 8:
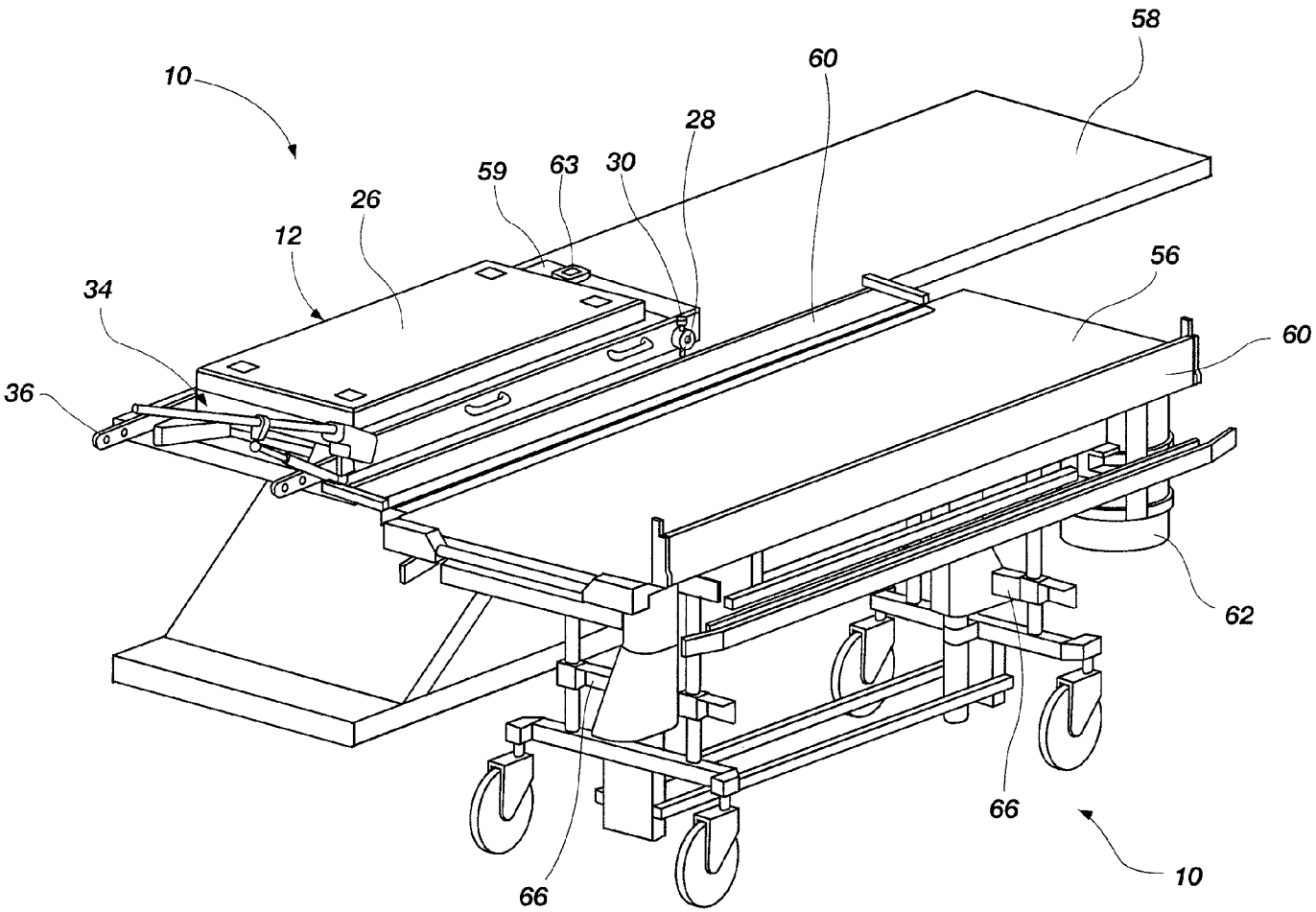
FIG. 8 is a perspective view of an embodiment of a patient transfer system that includes the patient transfer sled of FIG. 1.

FIG. 8 depicts an embodiment of a patient transfer system 10 in accordance with the principles of the present invention. The patient transfer system 10 provides for the transfer of a patient between adjacent supporting structures. System 10 may include a patient transfer sled 12, which may be configured to couple to a patient transport gurney or diagnostic imaging table or any other solid surface used to support a patient. The patient transport gurney, or other solid surface used to support a patient, may include lockable wheels. Further, a series of guides 28, 29 located laterally along opposing lengths of the patient transfer sled 12 may be used to couple the components of the system and prevent the accidental displacement of the patient transfer sled 12 from an underlying support surface, for example patient worktable 56 or diagnostic table 58. The patient transfer sled 12 of system 10 may include a bracket 36 at the base end 24 to receive a cantilevered leg support 34 (FIG. 1). In addition, the patient transfer sled 12 may have at least one air bearing formed therein. The air bearing is defined by at least one pocket 46, 48A, 48B formed in the support structure 14, with air cushions 47 attached to the interior of the one or more pockets 46, 48A, and 48B and having a plurality of holes 54 extending through the flexible material 52. As a result of the air bearing, the patient transfer sled 12 is capable of reduced friction or substantially frictionless movement over the other components in the system.

The patient transfer system 10 also includes a patient worktable 56 that may be a patient transport gurney, or similar apparatus. The patient worktable 56 may be adapted to have a bridge 60 connected thereto. The bridge 60 operates to close any surface gaps between the adjacent support structures since gaps might defeat the air bearing. The bridge 60 may be affixed to the patient worktable 56, by way of example and not limitation, using a hinge, so that the bridge 60 may be oriented either perpendicular or parallel to the patient worktable 56. Alternatively, in some embodiments, the bridge 60 may be affixed to a diagnostic table 58, for example. In still other embodiments, the bridge 60 may be a free-standing apparatus that may be positioned between the worktable 56 and the diagnostic table 58 to provide a continuous surface therebetween. The patient worktable 56 may, optionally, be adapted to have at least one stabilization mechanism 66 connected thereto. The stabilization mechanism 66 may prevent vertical movement of the surface of the worktable 56 during patient transfer. The stabilization mechanism 66 may facilitate providing adjacent support structures at the same elevation throughout patient transfer.

The patient transfer system 10 also may include a diagnostic table component 58. The patient may be transferred between the patient worktable 56 and the diagnostic table 58 on patient transfer sled 12. The diagnostic table 58 may be the support structure associated with an imaging machine like a CT or MRI. It may also include any other patient support apparatus. By way of non-limiting example, the patient transfer sled 12 may be used to move a patient between two tables or support structures rather than between a table or support structure and a diagnostic machine.

In addition, the patient transfer system 10 includes an air source 62 as described above. In an embodiment the patient worktable 56 may, by way of example and not limitation, be in combination with an air source 62 for supplying a high volume, low pressure amount of air to patient transfer sled 12. In other embodiments, the air source 62 may be in combination with the diagnostic table 58. In yet another embodiment, the air source 62 may be incorporated into the walls of the medical facility with a connection valve available in each room, which simply requires attachment of the air supply line. During operation of the patient transfer system 10, the air source 62 is continuously connected to the patient transfer sled 12; consequently, the air supply line may be produced so as to accommodate a distance between the air source 62 and the sled 12 following movement of the sled.

Also disclosed are methods of using the patient transfer sled 12, and, optionally, a patient transfer system 10, as described above, for transferring a patient for the purpose of medical treatment. A patient worktable 56, which may comprise a portable patient transport cart, is provided. With the handles 30 of the sled 12 rotated such that the guides 28 do not project downwards beyond the bottom surface 44 of the sled 12, and guides 29 clamped above the bottom surface 44 of the sled 12, the patient transfer sled 12 may be placed on the patient worktable 56, having stabilizer mechanisms 66 engaged (when present). Prior to treatment, a patient is placed in the lithotomy position (a position with the patient lying on his back, knees bent, thighs apart) on the support structure 14, the legs of the patient optionally being supported by the leg supports 34. Alternatively, the patient may be placed on the support structure 14, which may include one or more cushions 65, in any position for facilitating medical treatment.

Once the patient is securely positioned atop the patient transfer sled 12, various medical treatments may be undertaken. By way of non-limiting example, the treatment may be implantation of brachytherapy perineal implants for the treatment of prostate or cervical cancer. In some embodiments, such medical treatment will necessitate the transfer of a patient to a different support structure so that additional therapies or monitoring may occur. By way of non-limiting example, the patient may be transferred to a CT or MRI machine. Typically these diagnostic machines will include a table for a patient to rest upon. Accordingly, a patient may be moved from a patient worktable 56 to a diagnostic table 58 using the patient transfer sled 12 without disturbing implant placement.

To facilitate moving the patient, an air source 62 is connected to the fluid passageway 50 of the patient transfer sled 12. In an embodiment, the air source 62 may be a portable blower connected to a patient transport cart. In other embodiments, the air source 62 may comprise a fixed air blower or air compressor that is mounted in a room, an air supply line that is integral to the wall structure, or any other air source capable of supplying air to the one or more fluid passageways 50.

When the air supply is connected to at least one fluid passageway 50 the air cushions 47 disposed within the pockets are inflated and air passes through holes 54 to form an air film between the patient transfer sled 12 and the patient worktable 56. The patient is then moved from the patient worktable 56 to, for example, a diagnostic table 58, by positioning the patient worktable 56 adjacent the diagnostic table 58, and positioning the bridge 60 so as to bridge any gap between the worktable 56 and the diagnostic table 58, thereby providing an at least substantially continuous surface therebetween, as shown in FIG. 8. The patient transfer sled 12 then may be slid upon the air film or films generated by the air cushions 47 off from the worktable 56, over the bridge 60, and onto the diagnostic table 58. The patient transfer sled 12 and, consequently, the patient thereon may be positioned over the diagnostic table 58 by, for example, one or more technicians grasping handles 31 and applying a slight force in the desired direction of movement.

Following movement of the patient to the desired location, each handle 30 may be rotated so as to cause the guides 28 to project downward beyond the bottom surface 44 of the sled 12. Similarly, guides 29 may be lowered into a second position so as to project downward beyond the bottom surface 44 of the sled 12. In this configuration, the guides 28, 29 may project downward such that they are laterally disposed adjacent to side surfaces of the diagnostic table 58, thereby confining the diagnostic table 58 between the guides 28, 29 on opposing sides of the patient transfer sled 12 to prevent the sled 12 from unintentionally sliding sideways off from the diagnostic table 58.

Once the sled 12 and the patient are disposed on the diagnostic table 58, the sled 12 and patient may be slid on the air bearings of the sled 12 longitudinally along the diagnostic table 58 into a location at which diagnostic methods may be performed, such as, for example, into the imaging field of a CT or MRI machine.

The process described above may be reversed to transfer the patient from the diagnostic table 58 back to the patient worktable 56.

In additional embodiments, laterally extending pockets could be provided in the surfaces of the worktable 56, bridge 60, and diagnostic table 58, such that the guides 28, 29 could be positioned to project downward into the pockets as the patient transfer sled 12 is slid off from the worktable 56, over the bridge 60, and onto the diagnostic table 58. In other words, the guides 28, 29 could also be used to guide lateral movement of the patient transfer sled 12, in addition to longitudinal movement of the patient transfer sled 12.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A patient transfer sled, comprising:

a generally planar support structure having a first major surface for supporting a patient thereon and an opposing second major surface;

at least one air cushion adjacent the second major surface of the generally planar support structure, wherein the at least one air cushion comprises a flexible material at least partially surrounding a rigid material, and wherein a portion of the flexible material has a plurality of holes extending therethrough.

2. The patient transfer sled of claim 1, wherein the at least one air cushion comprises at least one air inlet.

3. The patient transfer sled of claim 2, further comprising a source of pressurized air coupled to the at least one air inlet and configured to supply air to the at least one air cushion.

4. The patient transfer sled of claim 3, wherein the source of pressurized air comprises an air blower.

5. The patient transfer sled of claim 4, wherein the air blower is in communication with a variable speed control.

6. The patient transfer sled of claim 2, wherein the at least one air inlet is configured to allow air to enter the at least one air cushion without air escaping from the at least one air cushion through the at least one air inlet.

7. The patient transfer sled of claim 1, further comprising at least one patient support cushion over the generally planar support structure.

8. The patient transfer sled of claim 1, wherein the flexible material of the at least one air cushion comprises a rubberized fabric.

9. The patient transfer sled of claim 1, wherein the flexible material of the at least one air cushion comprises vinyl.

10. The patient transfer sled of claim 1, further comprising a pressure valve for regulating a pressure of air within the at least one air cushion.

11. The patient transfer sled of claim 1, wherein the at least one air cushion defines a plurality of discontinuous volumes of air.

12. The patient transfer sled of claim 11, wherein the plurality of discontinuous volumes of air comprises a first volume of air having a length, a width, and a thickness and a second volume of air having a length, a width, and a thickness; wherein the second volume of air has at least one dimension different from the first volume of air, the at least one dimension different from the first volume of air selected from the group consisting of the length, the width, and the thickness.

13. The patient transfer sled of claim 1, wherein the flexible material at least partially surrounding a rigid material secures the flexible material to the rigid material.

14. A patient transport system comprising:

a table having an at least substantially planar upper surface;

a bridge attached to the table, the bridge comprising an at least substantially planar surface that may be oriented laterally adjacent to and at least substantially coplanar with the at least substantially planar upper surface of the table;

the patient transport sled of claim 1, the at least one air cushion disposed over the at least substantially planar upper surface of the table; and a source of pressurized air coupled to the patient transfer sled and configured to supply air to the at least one air cushion.

15. The patient transport system of claim 14, wherein the source of pressurized air comprises an air supply line incorporated into a wall of a building.

16. The patient transport system of claim 14, wherein the at least one air cushion defines a plurality of discontinuous volumes of air.

17. The patient transport system of claim 16, wherein the flexible material at least partially surrounding a rigid material secures the flexible material to the rigid material.

18. A method of moving a patient relative to a support surface, comprising:

positioning a patient on an upper surface of a generally planar support structure of a patient transfer sled;

at least partially inflating with a gas at least one cushion adjacent a lower surface of the generally planar support structure of the patient transfer sled to cause the patient and the generally planar support structure to be at least substantially supported over a surface underlying the patient transfer sled by the at least one cushion, wherein the at least one cushion comprises a flexible material at least partially surrounding a rigid material, a portion of the flexible material having a plurality of holes extending therethrough;

flowing pressurized gas from a gas source into the at least one cushion and out from the at least one cushion through the plurality of holes extending through the flexible material adjacent the surface underlying the patient transfer sled to form a volume of flowing gas between the flexible material of the at least one cushion and the surface underlying the patient transfer sled; and sliding the patient transfer sled with the patient thereon relative to the surface underlying the patient transfer sled over the volume of flowing gas.

19. The method of claim 18, wherein flowing pressurized gas from a gas source into the at least one cushion and out from the at least one cushion through the plurality of holes extending through the flexible material adjacent the surface underlying the patient transfer sled comprises maintaining a volume of gas within the at least one cushion.

20. The method of claim 18, further comprising:

orienting a bridge comprising an at least substantially planar surface laterally adjacent to and at least substantially coplanar with an at least substantially planar upper surface of a table, and sliding the patient transfer sled with the patient thereon over the bridge on the volume of flowing gas.

* * * * *